US008920922B2

(12) United States Patent
Yamamoto et al.

(10) Patent No.: US 8,920,922 B2
(45) Date of Patent: Dec. 30, 2014

(54) POLYURETHANE UREA ELASTIC FIBER

(75) Inventors: Taro Yamamoto, Tokyo (JP); Junichi Kojima, Tokyo (JP)

(73) Assignee: Asahi Kasei Fibers Corporation, Osaka (JP)

( * ) Notice: Subject to any disclaimer, the term of this patent is extended or adjusted under 35 U.S.C. 154(b) by 471 days.

(21) Appl. No.: 12/307,332

(22) PCT Filed: Jul. 3, 2007

(86) PCT No.: PCT/JP2007/063302

§ 371 (c)(1),
(2), (4) Date: Jan. 2, 2009

(87) PCT Pub. No.: WO2008/004549

PCT Pub. Date: Jan. 10, 2008

(65) Prior Publication Data

US 2009/0286441 A1 Nov. 19, 2009

(30) Foreign Application Priority Data

Jul. 4, 2006 (JP) ..... 2006-184757

(51) Int. Cl.

| | |
|---|---|
| ***D02G 3/00*** | (2006.01) |
| ***F16J 15/20*** | (2006.01) |
| ***D03D 15/08*** | (2006.01) |
| ***D04B 1/18*** | (2006.01) |
| ***D01F 6/94*** | (2006.01) |

(52) U.S. Cl.

CPC ..... *D01F 6/94* (2013.01)
USPC ..... 428/364; 428/365; 442/184; 442/306

(58) Field of Classification Search

USPC ..... 442/184, 306; 428/364, 365
See application file for complete search history.

(56) References Cited

U.S. PATENT DOCUMENTS

| | | | | |
|---|---|---|---|---|
| 5,616,676 | A | 4/1997 | Katsuo | |
| 6,403,216 | B1 * | 6/2002 | Doi et al. | 428/364 |
| 6,468,652 | B1 * | 10/2002 | Tsuru et al. | 428/364 |
| 2006/0030229 | A1 | 2/2006 | Fukuoka et al. | |

FOREIGN PATENT DOCUMENTS

| | | | |
|---|---|---|---|
| EP | 1 170 407 | A1 | 1/2002 |
| JP | 2001-55628 | | 2/2001 |
| JP | 2002-339166 | | 11/2002 |
| JP | 2002-339189 | | 11/2002 |
| JP | 2003-147618 | | 5/2003 |
| JP | 2005-113349 | | 4/2005 |
| JP | 2005-330617 | | 12/2005 |
| JP | 2005-350800 | | 12/2005 |
| JP | 2007-154321 | | 6/2007 |
| JP | 2007-177359 | | 7/2007 |
| KR | 10-2002-0073291 | | 9/2002 |
| WO | WO 2004/053218 | A1 | 6/2004 |

OTHER PUBLICATIONS

Office Action dated Mar. 16, 2011 issued in corresponding Korean application.

* cited by examiner

*Primary Examiner* — Jeremy R Pierce
(74) *Attorney, Agent, or Firm* — Finnegan, Henderson, Farabow, Garrett & Dunner, L.L.P.

(57) ABSTRACT

Disclosed is a polyurethane urea elastic fiber containing 5-40% by weight of a polyurethane compound, wherein the compression deformation starting temperature determined by thermomechanical analysis (TMA) is not less than 150° C. but not more than 180° C. and time for thermal cutting at 180° C. is not less than 30 seconds.

7 Claims, No Drawings

POLYURETHANE UREA ELASTIC FIBER

TECHNICAL FIELD

The present invention relates to a polyurethane-urea elastic fiber having heat fixing properties useful for preventing fray of clothing items formed of fiber having primarily polyurethane elastic fiber blended therein, and relates to knitted fabric or woven fabric using the elastic fiber.

BACKGROUND ART

Polyurethane elastic fiber is stretchable fiber excellent in elastic function and finds use in a wide variety of fields including clothing materials such as foundation garments, socks, pantyhose, swimming wear, sportswear and leotards; and non-clothing materials such as diapers, bandages, supporters, covering masks, automobile interior materials, nets and tapes.

Polyurethane elastic fiber is elastic fiber primarily constituted of segment polyurethane and basically constituted of block copolymers mainly containing high molecular-weight polyol, diisocyanate and a chain extender. In view of chemical structure, polyurethane elastic fiber is constituted of a soft segment excellent in flexibility and a hard segment having a crystalline structure formed by strong intermolecular force ascribed from hydrogen bonding. Furthermore, depending upon the type of chain extender constituting the hard segment, polyurethane elastic fibers can be classified into polyurethane-urea type, which uses a low-molecular diamine and has a urea bond, and polyurethane-urethane type, which uses a low molecular-weight polyol and has a urethane bond. The hydrogen bonding force of the hard segment has a large effect upon physical properties such as heat resistance. Since the hydrogen bonding force of the urea bond is stronger than that of the urethane bond, the polyurethane-urea type is superior in heat resistance and is in a main stream of polyurethane elastic fibers currently produced. For these reasons, the polyurethane-urea type is used in a wide variety of fields. In the present invention, the elastic fiber containing such a polyurethane-urea type polymer (hereinafter referred to as "polyurethane urea polymer") as a main component will be referred to as a "polyurethane urea elastic fiber". On the other hand, elastic fiber formed of a polyurethane-urethane type polymer is inferior in heat resistance and recoverability compared to polyurethane urea elastic fiber but has setting property at relatively low temperature. Taking advantage of this property, conversely, the elastic fiber formed of a polyurethane-urethane type polymer is applied to, for example, wool woven fabrics and zokki-type pantyhose.

When polyurethane urea elastic fiber is used in the general field of clothing materials, it is usually interknitted with polyamide fiber, polyester fiber, cotton etc., and subjected to manufacturing steps including cutting-out, sewing and finish processes to obtain clothing items. When the fabric interknitted using polyurethane urea elastic fiber is cut out and sewed, the fabric sometimes curls and frays at the edge depending upon the design of the fabric due to its high heat resistance and recoverability, rendering sewing difficult. Furthermore, polyurethane urea elastic fiber is removed from the knitted structure of cloth at the frayed hem, reducing stretchability of the portion of the cloth.

Since the edge of cloth will be frayed if it is allowed to stand as it is after cutting, the edge of general clothing items is more or less treated by any means to prevent fray. For example, generally, the cut edge is fold, doubled and sewed, or wrapped with another cut-cloth such as a tape and sewed.

However, post-processing work for preventing fray such as hemming and sewing takes time and labor in a process for producing clothing items and also economically provides a big burden. In addition, a clothing item hemmed and sewed at the edge becomes thick to form a stepped portion at the hem. In the case of underwear items such as foundation, the stepped portion protrudes when a person puts outerwear on the underwear, and appears as a projection of the outerwear, impairing appearance. Furthermore, polyurethane urea elastic fiber is frequently used in clothing items such as foundation garments and pantyhose which directly and tightly fit to a body. The thick hem makes the person uncomfortable to wear.

To overcome problems such as hemmed and sewed edges of clothing using polyurethane urea elastic fiber in the field of foundation garments such as brassieres, girdles and body suits, in which fashionable design items have been increasingly produced nowadays, a method for manufacturing a clothing item having a so-called cut-off opening parts has been studied to prevent a underwear line from appearing on outerwear by leaving the cut edge alone without hemming and sewing.

For example, a clothing item using fabric requiring no hemming has been proposed (see, for example, PATENT DOCUMENT 1). The clothing item is formed of knitted warp fabric, which is a 1×1 knit construction having the non-elastic fiber and elastic fiber run side by side and at least one side of the non-elastic fiber and the elastic fiber forms closed stitches at each knitting needle.

However, in this case of PATENT DOCUMENT 1, since fray of the cut edge is structurally suppressed by fabric design, the entire cloth becomes thick. Likewise, cloth obtained by fabric design is limited and uses of clothing items thereof are limited.

Furthermore, a clothing item also having a cut-off opening parts has been proposed (see PATENT DOCUMENT 2 or 3), which is obtained by using a low-melting point polyurethane elastic fiber composed of a polyurethane-urethane type in combination with another type of fiber and knitting them in the form of plating stitch and applying heat-set processing to impart a function of preventing fray.

However, in the polyurethane elastic fiber of a polyurethane-urethane type, physical properties significantly decrease by heat, which is applied in a setting step for fixing the shapes of fabric and clothing items and in a dyeing step. In addition, recoverability of fabric decreases and also breakage of polyurethane elastic fiber may occur in the temperature conditions usually employed for processing polyurethane urea elastic fiber. Consequently, clothing items employing this fabric is thermally limited in processing conditions.

Furthermore, a method for producing an stretchable fiber structural product rarely fraying is proposed (see PATENT DOCUMENT 4), which is obtained by subjecting a fiber structure, which uses polyurethane elastic fiber spun from a spinning solution containing at least two types of polyurethane components different in melting point at the high temperature side (for example, a polyurethane-urethane type and a polyurethane-urea type) to heat treatment performed at not less than a heat deformation temperature of the polyurethane component having a lower high-temperature side melting point.

Nevertheless, it cannot be said that the effect of suppressing fray of the fabric obtained in this manufacturing method is sufficiently satisfactory compared to the aforementioned case of using low-melting point polyurethane elastic fiber. In addition, no consideration is given to possibility of decreasing basic performances of elastic fiber, such as high recoverability and extensibility that a polyurethane-urea type possesses by adding not less than two types of polyurethane components different in structure.

PATENT DOCUMENT 1: JP-A-2003-147618
PATENT DOCUMENT 2: JP-A-2005-113349
PATENT DOCUMENT 3: JP-A-2005-350800
PATENT DOCUMENT 4: JP-A-2005-330617

DISCLOSURE OF THE INVENTION

Problems to be Solved by the Invention

An object of the present invention is to provide polyurethane urea elastic fiber having a high recoverability and heat resistance and having a function of preventing fray of clothing items and to provide knitted fabric or woven fabric using the elastic fiber. More specifically, use of the polyurethane urea elastic fiber of the present invention enables to provide fabric and clothing items reduced in limitation on fabric design and suppressed in curling and fraying caused by heat during processing thereof. Another object of the present invention is to provide polyurethane elastic fiber capable of providing fabric and clothing items having excellent physical properties even if processed at high temperature and to provide knitted fabric or woven fabric capable of providing clothing items suppressed in curing and fraying and maintaining excellent stretchability by use of the polyurethane urea elastic fiber.

Means for Solving the Problems

The present inventors have conducted intensive studies with a view toward solving the aforementioned problems. They found that the aforementioned problems can be solved by using polyurethane urea elastic fiber containing a specific polyurethane compound and having a heat deformation property and heat resistance as a polyurethane elastic fiber for improving curling and fraying prevention effect of clothing items, and knitted fabric and woven fabric using the elastic fiber. Based of the finding, the present invention was achieved.

More specifically, the present invention is as follows.

(1) Polyurethane urea elastic fiber containing 5 wt % to 40 wt % of a polyurethane compound, in which a compression deformation initiation temperature according to thermomechanical analysis (TMA) is not less than 150° C. and not more than 180° C. and the number of seconds up to thermal breakage at 180° C. is 30 seconds or more.

(2) The polyurethane urea elastic fiber according to item (1) above, in which the hardness of the polyurethane compound is 80 A or less.

(3) The polyurethane urea elastic fiber according to item (1) or (2), in which the polyurethane compound has no endothermic peak between 80° C. and the temperature at which decomposition of the polyurethane compound starts in differential scanning calorimetry (DSC).

(4) The polyurethane urea elastic fiber according to any one of items (1) to (3), in which the polyurethane compound is crosslinked polyurethane.

(5) The polyurethane urea elastic fiber according to any one of items (1) to (4), in which the polyurethane urea is obtained from a copolymerized polyalkylene ether diol serving as a raw material, which is composed of alkylene ethers having a different number of carbon atoms within 2 to 10.

(6) The polyurethane urea elastic fiber according to any one of items (1) to (5), in which the polyurethane compound is obtained from a copolymerized polyalkylene ether diol serving as a raw material, which is composed of alkylene ethers having a different number of carbon atoms within 2 to 10.

(7) The polyurethane urea elastic fiber according to any one of items (1) to (6), containing a dimethyl silicone component in an amount of not less than 1.0% and not more than 6.0%.

(8) Knitted fabric characterized by using the polyurethane urea elastic fiber according to any one of items (1) to (7) at least in a part.

(9) Woven fabric characterized by using the polyurethane urea elastic fiber according to any one of items (1) to (7) at least in a part.

Advantages of the Invention

When the polyurethane urea elastic fiber of the present invention is used in fabric and clothing items, compression deformation of the polyurethane urea elastic fiber occurs by tension applied to fabric, compression or residual stress of the polyurethane urea elastic fiber itself due to heat applied during processing treatment, at a point where polyurethane urea elastic fibers are in contact with each other or at a point where polyurethane urea elastic fiber is in contact with the other fiber used in combination. Since the polyurethane urea elastic fibers are fixed to each other or the other fiber is fixed to the polyurethane urea elastic fiber at the deformation point, the polyurethane urea elastic fiber and the other fiber are rarely removed from the fabric structure. As a result, fabric suppressed in curing and fraying can be obtained. Furthermore, since the polyurethane urea elastic fiber of the present invention is excellent in heat resistance and recoverability, thermal conditions during processing treatment are less limited and can be used in combination with any type of fiber generally used in fiber items in which the polyurethane urea elastic fiber is usually used to provide clothing items.

The knitted fabric or woven fabric using the polyurethane urea elastic fiber of the present invention has excellent processability during a sewing step since curling and fraying of the fabric can be suppressed by heat applied during processing treatment. In addition, fiber breakage of the fabric rarely occurs even if heat is applied during processing treatment, and polyurethane urea elastic fiber is scarcely removed from fabric structure to obtain high-quality fabric items. In addition, since deterioration of physical properties such as recoverability is low, stretchable clothing items tightly fitting to a body can be provided. Furthermore, fabric requiring no hemming of cut edge can be used as clothing items such as stretchable foundation garments very comfortable to wear.

BEST MODE FOR CARRYING OUT THE INVENTION

The invention of the present application will be more specifically described below.

The polyurethane urea elastic fiber of the present invention is composed of a composition containing a polyurethane urea polymer as a main component. Since the polyurethane urea polymer having high heat resistance is used as a main component, fibers are rarely broken by the heat during processing treatment and thus good stretchable fabric can be obtained. The content of the polyurethane urea polymer is preferably 60 wt % or more, and more preferably 75 wt % or more in view of heat resistance and physical properties of the polyurethane elastic fiber and fabric items thereof.

The polyurethane urea polymer to be used in the present invention can be obtained by reacting, for example, a high molecular-weight polyol, diisocyanate, low molecular-weight diamine and an end terminator having a monofunctional active hydrogen atom.

Examples of the high molecular-weight polyol include various types of diols, each composed of a substantially linear homopolymer or copolymer, such as polyester diol, polyether diol, polyester amide diol, polyacrylic diol, polythioester diol, polythioether diol, polycarbonate diol, a mixture of these or a copolymer of these. Preferably, a polyalkylene ether glycol is used, which includes polyoxyethylene glycol, polyoxypropylene glycol, polytetramethylene ether glycol, polyoxy pentamethyleneglycol, a copolymerized polyalkylene ether glycol composed of alkylene ethers having a different number of carbon atoms within 2 to 10, or a mixture of these. Of them, polytetramethylene ether glycol and a copolymerized polyalkylene ether glycol composed of alkylene ethers having a different number of carbon atoms within 2 to 10 showing excellent elastic function are suitable, and a polyalkylene ether glycol composed of alkylene ethers having a different number of carbon atoms within 2 to 10 is more suitable. Preferable examples of the copolymerized polyalkylene ether glycol composed of alkylene ethers having a different number of carbon atoms within 2 to 10 include a copolymerized polyether glycol composed of a tetramethylene group and a 2,2-dimethylpropylene group, and a copolymerized polyether glycol composed of a tetramethylene group and a 3-methyltatramethylene group. The number average molecular weight of the high molecular-weight polyol is preferably 500 to 5,000. More preferable number average molecular-weight is 1,000 to 3,000.

As the diisocyanate, diisocyanates of an aliphatic group, an alicyclic group and an aromatic group may be mentioned. Examples thereof include 4,4'-diphenylmethane diisocyanate, 2,4'-diphenylmethane diisocyanate, 2,4- and 2,6-tolylene diisocyanates, m- and p-xylylene diisocyanates, α, α,α'α'-tetramethyl-xylylene diisocyanate, 4,4'-diphenyl ether diisocyanate, 4,4'-dicyclohexyl diisocyanate, 1,3- and 1,4-cyclohexylene diisocyanates, 3-(α-isocyanatoethyl)phenyl isocyanate, 1,6-hexamethylene diisocyanate, trimethylene diisocyanate, tetramethylene diisocyanate, isophorone diisocyanate, a mixture of these or a copolymerized compound of these. Preferably, 4,4'-diphenylmethane diisocyanate is mentioned.

As the lower molecular-weight diamine used as a chain extender, for example, ethylenediamine, 1,2-propylenediamine, 1,3-propylenediamine, 2-methyl-1,5-pentanediamine, triethylenediamine, m-xylylenediamine, piperazine, o-, m- and p-phenylenediamines, 1,3-diaminocyclohexane, 1,4-diaminocyclohexane, 1,6-hexamethylenediamine, N,N'-(methylenedi-4,1-phenylene)bis[2-(ethylamino)-urea] may be mentioned. These can be used alone or as a mixture. Preferably, ethylenediamine alone or an ethylenediamine mixture containing 5 to 40% by mole of at least one selected from the group consisting of 1,2-propylenediamine, 1,3-diaminocyclohexane and 2-methyl-1,5-pentanediamine. More preferably, ethylenediamine alone is used.

As the end terminator having a monofunctional active hydrogen atom, for example, monoalcohols such as methanol, ethanol, 2-propanol, 2-methyl-2-propanol, 1-butanol, 2-ethyl-1-hexanol and 3-methyl-1-butanol; monoalkylamines such as isopropylamine, n-butylamine, t-butylamine and 2-ethylhexylamine; and dialkylamines such as diethylamine, dimethylamine, di-n-butylamine, di-t-butylamine, diisobutylamine, di-2-ethylhexylamine and diisopropylamine may be mentioned. These may be used alone or as a mixture. A monofunctional amine such as a monoalkylamine or a dialkylamine is more preferable than a monoalcohol.

As a method for producing a polyurethane urea polymer according to the present invention, a technique of a polyurethane formation reaction known in the art can be used. For example, a polyalkylene ether glycol and a diisocyanate are reacted, while the diisocyanate being excessively provided, to synthesize a urethane prepolymer having an isocyanate group at the ends. Subsequently, the urethane prepolymer is subjected to a chain extension reaction with a bifunctional amine to obtain a polyurethane urea polymer. In the present invention, a preferable polymer substrate is a polyurethane urea polymer, which is obtained by reacting polytetramethylene ether glycol having a number average molecular weight of 500 to 5000 and/or a copolymerized polyalkylene ether glycol composed of alkylene ethers having a different number of carbon atoms within 2 to 10 with an excessive amount of diisocyanate to synthesize a prepolymer having an isocyanate group at the ends; and then, reacting the prepolymer with a low molecular-weight diamine and a monofunctional amine.

In the operation of the polyurethane formation reaction, an amide-base polar solvent such as dimethylformamide, dimethylsulfoxide or dimethylacetamide can be used during the synthesis of a urethane prepolymer or during the reaction between a urethane prepolymer and an active hydrogen containing compound. Preferably, dimethylacetamide is used.

The polyurethane urea elastic fiber of the present invention is characterized by having a compression deformation initiation temperature according to thermomechanical analysis (TMA) from 150° C. to 180° C. (inclusive). When the compression deformation initiation temperature falls within the temperature range, a desired curling and fraying prevention function can be obtained under conventional processing conditions for polyurethane urea elastic fiber blended fabric items. In view of exerting fraying prevention function in the fabric, the compression deformation initiation temperature of the polyurethane urea elastic fiber is preferably 175° C. or less. In consideration of physical properties such as recoverability of fabric items after heat treatment during a processing step, the temperature is more preferably 160° C. or more.

The polyurethane urea elastic fiber of the present invention is characterized in that, in view of heat resistance for fiber breakage during processing fabric items, which is defined as follow: gray yarn is extended to 50% and brought into contact with a hot body of 180° C., the time to break is 30 seconds or more. The polyurethane urea elastic fiber is rarely broken even at high temperature, a fabric less affected by temperature conditions during processing can be provided.

The polyurethane urea elastic fiber of the present invention, as described above, has characteristics of excellent heat resistance at high temperature and tendency of deformation by compression at a lower temperature than this. Such a performance can be expressed by using a polyurethane urea polymer as a fiber substrate and a specific polyurethane compound in a specific amount.

The polyurethane urea elastic fiber of the present invention contains a polyurethane compound in an amount of not less than 5 wt % and not more than 40 wt %. When the content of the polyurethane compound is set to be 5 wt % or more, a curling and fraying prevention effect of fabric can be obtained. When the content is set to be 40 wt % or less, fabric having good elasticity can be obtained without damaging breaking strength and elongation, power and recoverability of the elastic fiber. The content of the polyurethane compound is more preferably not less than 10 wt % and not more than 30 wt %.

The polyurethane compound to be used in the present invention is a polymer whose hard segment is composed of a urethane bond and which can be obtained, for example, by reacting a high molecular-weight polyol, an isocyanate compound and a low molecular-weight polyol. In addition, an end terminator having a monofunctional active hydrogen atom may also be reacted.

As the high molecular-weight polyol, mention may be made of various type of diols formed of a substantially linear homopolymer or copolymer, including for example, polyester diol, polyether diol, polyester amide diol, polyacrylic diol, polythioester diol, polythioether diol, a mixture of these, or a copolymer of these; or polyols having not less than three functional groups in the molecule later described. As the polyether glycol formed of a substantially linear homopolymer or copolymer, polyoxyethylene glycol, polyoxypropylene glycol, polytetramethylene ether glycol, polyoxypentamethylene glycol, copolymerized polyalkylene ether glycol composed of alkylene ethers having a different number of carbon atoms within 2 to 10, a mixture of these, or the like may be mentioned. As the polyester diol formed of a substantially linear homopolymer or copolymer, an adipate-base polyester diol obtained by a condensation dehydration reaction between a dicarboxylic acid such as adipic acid or phthalic acid and a glycol such as ethylene glycol or 1,4 butanediol; polycaprolactone diol obtained by ring-opening polymerization of ϵ-caprolactone, polycarbonate diol, or the like may be mentioned. The high molecular-weight polyol preferably has a number average molecular weight of 500 to 2500, more preferably 600 to 2200, and particularly preferably 800 to 1800.

As the isocyanate compound, diisocyanates of an aliphatic group, an alicyclic group and an aromatic group, diisocyanate compounds having 3 or more functional groups in the molecule described later, etc. may be mentioned. As the diisocyanate compounds, for example, 4,4'-diphenylmethane diisocyanate, 2,4'-diphenylmethane diisocyanate, 2,4- and 2,6-tolylene diisocyanates, m- and p-xylylene diisocyanates, α,α,α',α'-tetramethyl-xylylenediisocyanate, 4,4'-diphenyl ether diisocyanate, 4,4'-dicyclohexyldiisocyanate, 1,3- and 1,4-cyclohexylene diisocyanates, 3-(α-isocyanatoethyl)phenyl isocyanate, 1,6-hexamethylene diisocyanate, trimethylene diisocyanate, tetramethylene diisocyanate, isophorone diisocyanate, a mixture of these or a copolymer of these, etc. may be mentioned. Preferably, 4,4'-diphenylmethane diisocyanate is mentioned.

As the low molecular-weight polyol, for example, ethylene glycol, 1,2-propylene glycol, 1,3-propylene glycol, 2,2-dimethyl-1,3-propanediol, 1,4-butanediol, 1,3-butanediol, hexamethylene glycol, diethylene glycol, 1,10-decanediol, 1,3-dimethylolcyclohexane, 1,4-dimethylolcyclohexane, low molecular-weight polyol having 3 or more functional groups in the molecule described later, etc. may be mentioned, which can be used as a chain extender. As the low molecular weight polyol, preferably ethylene glycol, 1,3-propanediol and 1,4-butanediol are mentioned.

As a method for producing a polyurethane compound that can be used in the present invention, a technique of a polyurethane formation reaction known in the art can be used. For example, there are a one-shot method in which three components, namely, a high molecular-weight polyol, an isocyanate compound and a low molecular-weight polyol, are all mixed at a time and reacted, or a prepolymer method in which a high molecular-weight polyol and an isocyanate compound excessively provided are reacted to synthesize a urethane prepolymer having an isocyanate group at the ends and subsequently, the urethane prepolymer is subjected to a chain extension reaction with a low molecular-weight polyol. Either one of the processes may be used to obtain polyurethane. In the operation of the polyurethane formation reaction, an amide-base polar solvent such as dimethylformamide, dimethylsulfoxide or dimethylacetamide can be used during the synthesis of a urethane prepolymer or during the reaction between a urethane prepolymer and a diol in the prepolymer process. Preferably, dimethylacetamide is used.

The polyurethane compound to be used in the present invention is preferred to have a low degree of hardness to exert a curling and fraying prevention effect. To obtain good fixation performance, the hardness of the polyurethane compound defined by JIS-K6253 is preferably 80 A or less, and more preferably 77 A or less.

The polyurethane compound to be used in the present invention preferably has no endothermic peak between 80° C. and the temperature at which decomposition of the polyurethane compound starts in differential scanning calorimetry (DSC). Usually, it is considered that such an endothermic peak is ascribed to fusion of a urethane hard segment mainly composed of a low molecular-weight polyol and an isocyanate compound in the polyurethane compound polymer. The polyurethane compound having no endothermic peak may have a low hard-segment ratio or a loose hard structure. Furthermore, the decomposition temperature of the polyurethane compound is measured as the temperature at which large thermal reduction occurs in thermogravimetry (TG). When a polyurethane compound having no distinguishable endothermic peak detectable by DSC measurement in such a temperature range is used, in other words, causing no abrupt fusion of a hard segment at a specific temperature, is used, good fixation performance can be obtained. Besides this, since no abrupt structural change occurs in polyurethane urea elastic fiber before and after the endothermic peak temperature of the polyurethane compound also by application of heat during processing treatment, good recoverability can be obtained when polyurethane urea elastic fiber is expanded or contracted.

As the polyurethane compound having such a nature can be suitably obtained by a method of reducing a molecular weight ratio of the hard segment by changing the equivalent ratio of an isocyanate compound to a high molecular-weight polyol in obtaining a polyurethane polymer; by a method of using a mixture of two types or more low molecular-weight polyols; by a method using the crosslinked polyurethane described below, or by using copolymerized polyalkylene ether glycol as a raw material for the polyurethane polymer described later.

As the polyurethane compound to be used in the present invention, a crosslinked polyurethane compound is more suitable since it imparts high heat resistance and recoverability to a polyurethane urea elastic fiber. In the present invention, the crosslinked polyurethane compound refers to a compound of a polyurethane polymer partly having a three-dimensional network structure due to a branched structure of a polyurethane molecule or an allophanate bond and an isocyanurate structure. To obtain the crosslinked polyurethane compound, there are methods including a method using a high molecular-weight polyol having not less than three functional groups in the molecule, an isocyanate compound and a low molecular-weight polyol, and a method for producing a crosslinking structure by an allophanate bond and isocyanurate during a reaction for diisocyanate. In view of moldability, a polyurethane compound having a crosslinked structure via an allophanate bond is preferred.

As the polyol having not less than three functional groups in the molecule, glycerol, hexanetriol, triethanol amine, diglycerol, pentaerythritol, sorbitol; or polyetherpolyol, polyester polyol or polymer polyol using these as an initiator may be mentioned. As the isocyanate compound, triphenylmethane triisocyanate, tris(isocyanatephenyl)thiophosphate, lysine ester triisocyanate, 1,6,11-undecane triisocyanate, 1,3,6-hexamethylene triisocyanate, and allophanate-modified polyisocyanates and polyurethane-modified polyisocyanates obtained from various types of isocyanate compounds may be mentioned.

As the method for producing a crosslinked polyurethane compound having a crosslinked structure via an allophanate bond, for example, there are the following methods. For example, a low molecular-weight polyol is added in a functional group ratio such that an isocyanate group will remain during a step of extending a chain with a low molecular-weight polyol in accordance with the prepolymer method, and thereafter, the extended chain is maintained while heating in a homothermal vessel of 80° C. or more until the isocyanate group disappears, thereby obtaining a crosslink. Alternatively, for example, after the chain is extended with a low molecular-weight polyol excessive diisocyanate compound is added and maintained while heating in the same manner as above, thereby obtaining crosslinking.

As the polyurethane compound to be used in the present invention, it is more preferred to use a copolymerized polyalkylene ether glycol composed of alkylene ethers having a different number of carbon atoms within 2 to 10. Preferable examples of the copolymerized polyalkylene ether glycol composed of alkylene ethers having a different number of carbon atoms within 2 to 10 may include a copolymerized polyether glycol composed of a tetramethylene group and a 2,2-dimethylpropylene group and a copolymerized polyether glycol composed of a tetramethylene group and a 3-methyltetramethylene group. The copolymerization ratios of the 2,2-dimethylpropylene group or 3-methyltetramethylene group relative to the tetramethylene group is preferably 5 to 35% by mole in view of dynamics properties, and more preferably 5 to 20% by mole.

The polyurethane urea elastic fiber of the present invention can be suitably produced by dissolving a polyurethane compound and polyurethane urea polymer as mentioned above in an amide-base polar solvent to obtain a polyurethane urea spinning solution, which is then subjected to dry-spinning. The dry-spinning is preferred because crosslinking between hard segments via a hydrogen bond can be formed physically most strongly compared to melt spinning and wet spinning. Furthermore, when the content of a polyurethane compound in an elastic fiber is set to be 40 wt % or less, the elastic fiber can be stably produced without problems such as fiber breakage during a spinning process when dry spinning is employed and a high-quality polyurethane elastic fiber without spots in the fiber-length direction. As the amide-base polar solvent, dimethylformamide, dimethylsulfoxide and dimethylacetamide may be mentioned. Any method may be used to add a polyurethane compound in polyurethane urea elastic fiber; however, in consideration of production steps, it is preferred to subject a polyurethane-urea composition having a polyurethane compound and a polyurethane urea polymer homogeneously mixed therein to spinning.

As a method of mixing a polyurethane compound and a polyurethane urea polymer, for example, by mixing them homogeneously in a polyurethane composition, there are methods including a method of mixing a solution of a polyurethane compound synthesized in an amide-base polar solvent and a polyurethane urea polymer solution with each other; a method of dissolving a polyurethane compound polymerized in the absence of a solvent in an amide base polar solvent and thereafter added to a polyurethane urea polymer solution; a method of adding a polyurethane compound melted to a polyurethane urea polymer solution; a method of dissolving powdery or pellet-form polyurethane compound in a solution of polyurethane urea polymer in an amide base polar solvent.

To the polyurethane-urea spinning solution, other compounds usually used for polyurethane urea elastic fiber such as a UV absorber, an antioxidant, a light stabilizer, a gas-resistant coloring preventing agent, a chlorine-resistant agent, a colorant, a delustering agent, a lubricant and a filler may be added.

The polyurethane urea elastic fiber of the present invention preferably contains dimethyl silicone in an amount of not less than 1.0 wt % and not more than 6.0 wt %. When dimethyl silicone is contained in an amount of 1.0 wt % or more, yarn using the polyurethane urea elastic fiber can be satisfactorily released from a package. In particular, even after the package is stored for a long time, a reduction of releasability can be suppressed. On the other hand, when the content of dimethyl silicone is set to be 6.0 wt % or less, failure in winding yarn from the package can be reduced. The content is more preferably not less than 2.5 wt % and not more than 5.5 wt %.

Furthermore, in the polyurethane urea elastic fiber of the present invention, the content of modified silicone is preferably less than 0.001 wt %. The modified silicone is obtained by modifying an end of a dimethyl silicone chain and a side chain in the middle thereof with a functional group. For example, amino modified silicone, polyether modified silicone, polyester modified silicone, alcohol modified silicone, alkoxy modified silicone may be mentioned. When the content is set to be less than 0.001 wt % in the polyurethane urea elastic fiber, the polyurethane urea elastic fiber can exert higher heat fixation effect. More preferably, modified silicone is not contained.

To add the aforementioned dimethyl silicone and modified silicone to polyurethane urea elastic fiber, an oil solution based on mineral oil or the like and containing dimethyl silicone component may be added. The oil solution may be added to polyurethane urea elastic fiber after dry spinning. Alternatively, the oil solution is previously added to the spinning stock solution, which is then subjected to dry spinning. When the oil solution is added after dry spinning, the timing of addition is not particularly limited as long as the oil solution is added after the spinning stock solution is subjected to dry spinning to form fiber; however, the timing is preferred to be immediately before winding-up by a winding roller. As the addition method, known methods may be employed, which include a method of forming an oil film on the surface of a metal cylinder by rotating it in an oil solution bath and bringing yarn immediately after spinning into contact with the oil film, or a method of depositing a predetermined amount of oil solution ejected from a nozzle tip equipped with a guide onto yarn. Furthermore, when the oil solution is added to the spinning stock solution, the oil solution may be added at any time during the process for producing the spinning stock solution. The oil solution may be dissolved or dispersed in the spinning stock solution. The content of oil solution in polyurethane urea elastic fiber is preferably not less than 1.0 wt % and not more than 6.0 wt %.

As the oil solution, other than dimethyl silicone and mineral oil, modified silicones such as amino modified silicone, polyether modified silicone, polyester modified silicone, alcohol modified silicone and alkoxy modified silicone may be added. The total content of the modified silicones in the oil-solution component is preferably less than 1.0 wt %. More preferably, the modified silicones are not contained. Furthermore, it is preferred to change the content of the dimethyl silicone component in the oil-solution in accordance with the content of the oil solution in polyurethane elastic fiber such that dimethyl silicone component is contained in an amount of not less than 1.0 wt % and not more than 6.0 wt % when it is added to the polyurethane elastic fiber. The content of dimethyl silicone in the oil solution is preferably 50 wt % or more. Furthermore, as the oil solution, fine mineral particles such as talc and colloidal alumina; higher fatty acid metal slat powders such as magnesium stearate and calcium stearate; solid waxes at room temperature such as higher fatty acid carboxylic acids, higher aliphatic alcohols, paraffin and polyethylene may be used alone or in an arbitral combination.

The polyurethane urea elastic fiber of the present invention can be used in combination with other fiber materials to obtain fabrics such as knitted fabric and woven fabric. Examples of the fabrics include stretchable foundation garments such as girdles, brassieres, intimate goods and underwear; and clothing items such as tights, pantyhose, waistbands, body suits, spats, swimming wear, stretchable sports clothes, stretchable outers, medical ware and stretchable lining.

The fiber to be used in combination with the polyurethane urea elastic fiber of the present invention constituting the knitted fabric and woven fabric is one or two or more selected from natural fibers such as cotton, wool and hemp; regenerated fibers such as rayon, lyocell and Cupra; semi-synthesized fibers such as acetate and triacetate; and synthesized fibers such as polyamide fiber, polyester fiber, acrylic fiber, polypropylene fiber and polyvinyl chloride fiber.

The fiber to be used in combination with the polyurethane urea elastic fiber may be either filament yarn or spun yarn. The form of the filament yarn may be any one of original yarn (non-finished yarn), false twisted yarn and dyed yarn or conjugate yarn. These may be obtained either by single spinning or mixed spinning. These fibers may be blended or doubled with the polyurethane urea elastic fiber. Furthermore, the polyurethane urea elastic fiber may be used as bare yarn or coated elastic yarn.

As the coated elastic yarn, covering yarn called FTY, SCY or DCY, which is obtained by coating polyurethane urea elastic fiber used as a core with multifilament synthetic fiber such as polyester fiber or polyamide fiber or short fiber such as cotton serving a sheath component; core spun yarn called CSY coated with short fiber such as cotton, coated elastic yarn obtained by twisting non-elastic fiber, polyurethane urea elastic fiber, etc. may be mentioned.

The knitted fabric of the present invention is not particularly limited and may be any one of a circular knitted fabric, a weft knitted fabric and a warp knitted fabric. The knitted structure that can be used in the circular knitted fabric and weft knitted fabric of the present invention may be any one of a basic structure of plain-stitch or any one of structures of tuck stitch, float stitch, half cardigan stitch, race stitch, plating stitch and jacquard stitch.

The circular knitted fabric of the present invention is knitted by use of a knitting machine having a number of feeders such as a conventional single knit circular knitting machine or a double knit knitting machine and capable of feeding a plurality of yarns at the same time. The gauge of the knitting machine is usually 5 to 50 gauges and appropriately selected depending upon the purpose of use.

The weft knitted fabric of the present invention is knitted by a weft knitting machine such as a large weft knitting machine, a small weft knitting machine, a double head machine, a double-face machine, or a jacquard machine, or a full-fashion knitting machine such as a single needle machine or a double needle machine. The gauge of the knitting machine is usually 3 to 50 gauges and appropriately selected depending upon the purpose of use.

The knitted structure that can be used in the warp knitted fabric of the present invention may be any one of basic structures such as chain stitch, Denbigh stitch, cord stitch, Atlas stitch, and insertion stitch, or a modified structure provided by a combination of these. The polyurethane urea elastic fiber may be knitted throughout the fabric or at desired intervals. In addition, the polyurethane urea elastic fiber may be inserted.

The warp knitted fabric of the present invention is obtained as follows. In a warping step using a Karl Meier warping machine, a River warping machine or the like, a predetermined number (determined in accordance with a desired product) of elastic fibers and/or coated elastic fibers and non-elastic fibers are separately arranged and wound up by a beam. Thereafter, the beams of elastic fibers and/or coated elastic fibers and non-elastic fibers are set at the knitting machine described later. Then, knitting is performed to obtain a desired warp knitted fabric.

In knitting of the warp knitted fabric, a tricot knitting machine, a Russell knitting machine and a double Russell knitting machine can be used. Depending upon the purpose of a product, the denier, type of knitting machine and gauge to be used may be appropriately selected. As the knitted structure, the aforementioned basic knitted structures and a modified structure provided by a combination of these may be used. When the tricot knitting machine of two reed structures is used, a desired warp knitted fabric can be obtained by a half structure, a satin structure, a jacquard structure, a modified structure provided by a combination of these structures, etc. When the Russell knitting machine or double Russell knitting machine is used, a desired warp knitted fabric can be obtained by a power net structure, a satin net structure, a jacquard structure, etc. In both tricot knitting machine and Russell knitting machine, knitting may be formed of three or more reed structures. The gauge of the knitting machine is usually 10 to 50 gauges and appropriately selected depending upon the purpose of use.

In weaving of the woven fabric of the present invention, the polyurethane urea elastic fiber may be used as bare yarn; however, in view of resistance and touch feeling, it may be used in combination with other fibers. As a method of combining fibers, paralleled yarn and coated elastic fiber such as covered yarn, etc. may be mentioned. Not only a single type of fiber is combined but also a plurality types of fibers may be combined. As the elastic fiber, the polyurethane urea elastic fiber of the present invention may be used alone or in a combination with a conventional polyurethane elastic fiber, etc. As a preparation step for conjugate yarn, a step known in the art may be used. For sizing or waxing, agents used in the art may be employed.

The structure of woven fabric that can be used for woven fabric of the present invention may be plain weave, twill weave, satin weave structures, a modified structure derived from these structures, etc. The structure is not particularly limited as long as it is known in the art. Any one of the structures may be used.

In weaving the woven fabric of the present invention, a weaving machine known in the art may be used which, for example, includes a water jet loom (WJL), an air jet loom (AJL) and a rapier loom. In warping, not only conjugate yarn using the polyurethane urea elastic fiber of the present invention alone may be used as the warp but also elastic fiber other than that of the present invention or non-elastic fiber may be used in combination. Yeans may be arranged by a method generally known in the art. The arrangement method may be determined depending upon the structure and density. Also, as the weft, not only conjugate yarn containing the polyurethane urea elastic fiber of the present invention alone may be used but also conjugate yarn using elastic fiber other than that of the present invention and non-elastic fiber may be arranged in combination, similarly to the case of the warp. The polyurethane urea elastic fiber of the present invention may be used throughout the woven fabric or inserted along either one of the longitudinal and latitude directions.

The knitted fabric and woven fabric of the present invention are dyed in a processing step customarily performed for conventional polyurethane urea elastic fiber mixed fabric to obtain final items. For example, gray fabric is refined, subjected to relaxation treatment, a preset step, a dyeing step and a finishing/final set including various processing treatments. Such a general dyeing process can be employed. After the preset step, refining may be performed; however, in order for the polyurethane urea of the present invention to exert a fixation effect, refining is preferably performed first. As the preset conditions, temperature and time at which polyurethane urea elastic fiber is generally used may be employed. To prevent curls and frays of fabric items, preset is preferably performed at a temperature of is 150° C. to 200° C. for 30 seconds to 2 minutes. The final set may be performed also in the same temperature and time conditions. As is in the same as in the preset step, to prevent frays and curls of fabric items, the temperature of the final set is set at 150° C. to 200° C.; however, preferably lower by 5 to 10° C. than the temperature of the preset step. Furthermore, the processing time of the final set is preferably 30 seconds to 2 minutes. In the dyeing step, the dyeing processing may be performed at the dyeing temperature conventionally used for the other fiber to be used in combination. For example, when the other fiber is polyamide fiber, dyeing can be performed in dyeing conditions (90 to 110° C.) of acidic dyes. In the case of polyester fiber, dyeing is performed in the dyeing conditions (120° C. to 135° C.) with dispersion dye.

The knitted fabric and woven fabric of the present invention may be subjected to processing treatment conventionally applied to fabric having polyurethane urea elastic fiber used therein. To improve color fastness of fabric, treatments with various types of finishing agents may be performed including a soaping treatment, a fixation treatment and a softening treatment and water-absorption treatment to control touch feeling. The treatments are not particularly limited to these.

EXAMPLES

The present invention will be explained based on Examples below; however the present invention is not limited to the range of these.

Various methods for evaluating the performance of polyurethane elastic fiber will be described below.

(1) Compression Deformation Initiation Temperature According to Thermochemical Analysis (TMA)

Polyurethane elastic fiber, from which oil solution is removed with petroleum ether, is dried and then dissolved in dimethylacetamide to obtain a 20% solution. The solution was uniformly cast on a glass plate to thickness of 0.6 mm by use of an applicator. This is dried at 70° C. for 16 hours to remove dimethylacetamide to obtain a film of about 0.12 mm in thickness.

The temperature of the film is increased at a rate of 10° C./minute from room temperature in a compression mode of a thermochemical analysis apparatus (TMA/SS120 Type manufactured by Seiko Instrument Inc.) using a pushing-up probe having a diameter of ϕ 1.2 mm under constant pressurization of 5 g. The film is expanded as the temperature increases. The temperature of an infection point at which expansion changes to compression deformation is defined as compression deformation initiation temperature.

(2) The Number of Seconds Until Thermal Breakage

A test yarn having an initial length of 14 cm is expanded by 50% to obtain yarn of 21 cm, which is brought into pressure contact with a cylindrical hot body of 6 cm in diameter having a surface temperature of 180° C. (contact portion: 1 cm). The number of seconds is measured until the yarn breaks.

(3) Differential Scanning Calorimetry (DSC) of Polyurethane Compound

A polyurethane compound (about 10 mg) is measured by a differential scanning calorimeter (DSC 210 Type manufactured by Seiko Instrument Inc.) while supplying nitrogen gas at 50 ml/minute at a temperature raising rate of 10° C./minute, from 20° C. to 300° C.

(4) Recovery Rate of Original Yarn when Extended to 300% and Recovered

A yarn having an initial length of 5 cm is set at a tension tester (UTM-III-100 Type (trademark) manufactured by Orientec Co. Ltd.) at 20° C. in 65% RH atmosphere. The yarn is extended at a rate of 1000%/minute up to a degree of extension of 300% and then allowed to recover. This operation is repeated three times. Assuming that the degree of extension is regarded as H (%) when the stress during third recovery time becomes 0, a recovery rate L (%) can be obtained in accordance with the equation: L (%)=100−H.

(5) Evaluation of Fray

Test pieces are prepared by cutting knitted fabric along the stitches into squares having a side length of 10 cm. The test pieces are washed by a laundry machine containing 20 g of detergent Attack (trademark) manufactured by KAO Corporation in 30 L water for 15 minutes/time. Every 5 washes, the presence or absence of frays at the edges of test pieces is checked. The number of washing times until fray occurs is used for evaluation.

(6) Degree of Hardness

Flat-plate form test pieces of a polyurethane compound having not less than 6 mm in thickness are prepared and the degree of hardness is measured by a method using a durometer (hardness tester), described in JIS-K7311.

Example 1

With polytetramethylene ether glycol having a number average molecular weight of 2000, 4,4'-diphenylmethane diisocyanate (1.6 fold equivalent to the polytetramethylene ether glycol) was reacted in a dry nitrogen atmosphere at 80° C. for 3 hours with stirring to obtain a polyurethane prepolymer having ends capped with isocyanate. After the prepolymer was cooled to room temperature, dimethylacetamide was added to dissolve the prepolymer. In this manner, a polyurethane prepolymer solution was obtained.

On the other hand, ethylenediamine and diethylamine were dissolved in dry dimethylacetamide to prepare a solution, which was added to the prepolymer solution at room temperature to obtain a polyurethane urea polymer solution PA1 having a polyurethane solid matter concentration of 30 wt % and a viscosity of 450 Pa·s (30° C.).

Separately, with polytetramethylene ether glycol having a number average molecular weight of 2000, 4,4'-diphenylmethane diisocyanate (3.0 fold equivalent to the polytetramethylene ether glycol) was reacted in a dry nitrogen atmosphere at 80° C. for 3 hours with stirring to obtain a polyurethane prepolymer having ends capped with isocyanate. To the prepolymer, 1,4-butandiol (0.95 fold equivalent relative to the isocyanate group in the prepolymer) was added and reacted. Thereafter, the reaction mixture was heated at 80° C. for 16 hours to obtain a polyurethane compound having a hardness of 80 A and no endothermic peak in DSC from 80° C. to the decomposition initiation temperature (282° C.). To the polyurethane compound, dimethylacetamide was added to obtain a polyurethane solution PU1 having a solid matter concentration of 30 wt %.

The obtained polyurethane urea solution and polyurethane solution were added in a ratio of PA1:PU1=80:20. 1 wt % of 4,4'-butylydenebis(3-methyl-6-t-butylphenol) and 0.5 wt % of 2-(2'-hydroxy-3'-t-butyl-5'-methylphenyl)-5-chlorobenzotriazole relative to the total solid matter of polyurethane urea and polyurethane were blended with the polyurethane solution to obtain a homogenous solution, which was then defoamed at room temperature under reduced pressure to obtain a spinning stock solution.

The spinning stock solution was subjected to dry-spinning at a spinning rate of 800 m/minute in a hot air of 310° C. in temperature. Before the polyurethane urea elastic fiber obtained was wound up by a package, 4 wt % of an oil solution containing polydimethylsiloxane (80 wt %), a mineral oil (18 wt %) and magnesium stearate (2 wt %) was added to the polyurethane elastic fiber as a finishing agent. The resultant fiber was wound up by a paper tube made of paper to obtain a polyurethane urea elastic fiber having 44 decitex/4 filaments.

Example 2

In place of the polyurethane solution PU1 of Example 1, polyurethane solution PU2 was obtained as follows. With polytetramethylene ether glycol having a number average molecular weight of 2000, 4,4'-diphenylmethane diisocyanate (2.4 fold equivalent to the polytetramethylene ether glycol) was reacted in a dry nitrogen atmosphere at 80° C. for 3 hours with stirring to obtain polyurethane prepolymer having ends capped with isocyanate. To the prepolymer, 1,4-butandiol (1.0 fold equivalent relative to isocyanate group in the prepolymer) was added and reacted. Thereafter, 4,4'-diphenylmethane diisocyanate was further added to the reaction solution in an amount of 3 wt % of the initial addition amount and homogenized. The reaction mixture was heated at 80° C. for 16 hours to obtain a polyurethane compound having a hardness of 75 A and no endothermic peak in DSC from 80° C. to the decomposition initiation temperature (253° C.). To the polyurethane compound, dimethylacetamide was added to obtain a polyurethane solution PU2 having a solid matter concentration of 30 wt %.

The obtained polyurethane urea solution was added such that the ratio of PA1:PU2 was 80:20 to obtain a polyurethane urea elastic fiber having 44 decitex/4 filaments in the same manner as in Example 1.

Example 3

A polyurethane urea elastic fiber having 44 decitex/4 filaments was obtained in the same manner as in Example 1 except that the polyurethane urea solution and the polyurethane solution of Example 2 were added in a ratio of PA1:PU2=65:35.

Example 4

In place of polyurethane solution PU1 of Example 1, a polyurethane solution PU3 was obtained as follows. With a copolymerized polyether glycol, which was constituted of a tetramethylene group having a number average molecular weight of 2000 and a 2,2-dimethylpropylene group and had a molar ratio of the 2,2-dimethylpropylene group of 10% by mole, 4,4'-diphenylmethane diisocyanate (2.4 fold equivalent to the copolymerized polyether glycol) was reacted in a dry nitrogen atmosphere at 80° C. for 3 hours with stirring to obtain a polyurethane prepolymer having ends capped with isocyanate. To the prepolymer, 1,4-butandiol (0.95 fold equivalent relative to the isocyanate group in the prepolymer) was added and reacted in the same manner to obtain a polyurethane compound having a hardness of 77 A and no endothermic peak in DSC from 80° C. to the decomposition initiation temperature (264° C.). To the polyurethane compound, dimethylacetamide was added to obtain a polyurethane solution PU3 having a solid matter concentration of 30 wt %.

The obtained polyurethane solution was added such that the ratio of PA1:PU3 was 80:20 to obtain a polyurethane urea elastic fiber having 44 decitex/4 filaments in the same manner as in Example 1.

Example 5

In place of polyurethane solution PU1 of Example 1, a polyurethane solution PU4 was obtained as follows. With polybutylene adipate diol having a number average molecular weight of 1000, 4,4'-diphenylmethane diisocyanate (3.0 fold equivalent to the polybutylene adipate diol) was reacted in a dry nitrogen atmosphere at 80° C. for 3 hours with stirring to obtain a polyurethane prepolymer having ends capped with isocyanate. To the prepolymer, 1,4-butandiol (0.95 fold equivalent relative to the isocyanate group in the prepolymer) was added and reacted in the same manner to obtain a polyurethane compound having a hardness of 66 A and no endothermic peak in DSC from 80° C. to the decomposition initiation temperature (302° C.). To the polyurethane compound, dimethylacetamide was added to obtain a polyurethane solution PU4 having a solid matter concentration of 30 wt %.

The obtained polyurethane solution was added such that the ratio of PA1:PU4 was 80:20 to obtain a polyurethane urea elastic fiber having 44 decitex/4 filaments in the same manner as in Example 1.

Example 6

Polyurethane urea polymer solution PA2 was obtained in the same manner as in Example 2 except that a copolymerized polyether glycol constituted of a tetramethylene group having a number average molecular weight of 2000 and a 2,2-dimethylpropylene group (a copolymerization ratio of the 2,2-dimethylpropylene group of 10% by mole), was used in place of the polytetramethylene glycol having a number average molecular weight of 2000. A polyurethane elastic fiber having 44 decitex/4 filaments was obtained in the same manner as in Example 2 except that the polyurethane urea polymer solution PA2 was used in placed of the polyurethane urea polymer solution PA1.

Example 7

PA2 used in Example 6 was mixed with PU3 used in Example 4 in a ratio of PA2:PU3=80:20 to obtain a polyurethane elastic fiber having 44 decitex/4 filaments in the same manner as in Example 1.

Comparative Example 1

A polyurethane urea elastic fiber having 44 decitex/4 filaments was obtained in the same manner as in Example 1 except that polyurethane compound PU1 was not added (additives were added in amounts in accordance with the solid matter of PA1).

Comparative Example 2

A polyurethane urea elastic fiber having 44 decitex/4 filaments was obtained in the same manner as in Example 2 except that polyurethane urea polymer PA1 was not added (additives were added in amounts in accordance with the solid matter of PU2).

Comparative Example 3

In place of the polyurethane solution PU1 of Example 1, polyurethane solution PU5 was obtained as follows.

With polytetramethylene ether glycol having a number average molecular weight of 2000, 4,4'-diphenylmethane diisocyanate (5.1 fold equivalent to the polytetramethylene ether glycol) was reacted in a dry nitrogen atmosphere at 80° C. for 3 hours with stirring to obtain polyurethane prepolymer having ends capped with isocyanate. Thereafter, to the prepolymer, 1,4-butandiol was added and reacted to obtain a polyurethane compound having a hardness of 90 A and having an endothermic peak in DSC at 230° C., which was lower than the decomposition initiation temperature (290° C.). To the polyurethane compound, dimethylacetamide was added to obtain a polyurethane solution PU5 having a solid matter concentration of 30 wt %.

The obtained polyurethane solution was added such that the ratio of PA1:PU5 was 80:20 to obtain a polyurethane elastic fiber having 44 decitex/4 filaments in the same manner as in Example 1.

<Formation of Knitted Fabric>

Bear yarns of polyurethane urea elastic fibers having 44 decitex/4 filaments obtained in Examples and Comparative Examples above and nylon 66 processed yarn having 78 decitex/34 filaments were doubled and knitted at a nylon 66 feed rate of 86 m/minute and a polyurethane urea elastic fiber feed rate of 39 m/minute, at a draft of 2.2, a yarn feed tension of 5 cN to obtain a plain-stitch knitted fabric. Knitting was performed by a single circular kitting machine (VXAC-3SRE Type manufactured by Precision Fukuhara Works, Ltd.) having 28 gauges, 30 inch in diameter and 60 feeders to obtain a circular knitted fabric.

The circular knitted fabric obtained was opened and refined by a jet dyeing machine in the conditions of 80° C.×30 minutes, preset, treated with heat at 190° C. for 60 seconds while broadening by 5% in the width direction by a pin-tenter finishing machine and then dyed in the conditions of 100° C.×60 minutes. As a final set, heat treatment was performed at 180° C.×45 seconds while tendering by 3% in the width direction by a tenter finishing machine to obtain dyed items.

The compositions of Examples and Comparative Examples above are shown in Table 1 and the performances of the obtained polyurethane urea elastic fibers are shown in Table 2. The physical properties of knitted fabrics using elastic fibers according to Examples and Comparative Examples are shown in Table 3.

From the obtained results, it was found that good fabrics having good quality and recoverability without yarn breakage and fray of fabric during processing can be obtained by use of the polyurethane urea elastic fiber of the present invention.

TABLE 1

| | Polyurethane urea (PA) | | | | |
|---|---|---|---|---|---|
| | No. | Polyol | Number average molecular weight | Isocyanate | Linking agent |
| Example 1 | PA1 | PTMG | 2000 | MDI | EDA |
| Example 2 | PA1 | PTMG | 2000 | MDI | EDA |
| Example 3 | PA1 | PTMG | 2000 | MDI | EDA |
| Example 4 | PA1 | PTMG | 2000 | MDI | EDA |
| Example 5 | PA1 | PTMG | 2000 | MDI | EDA |
| Example 6 | PA2 | Copolymerized PTMG | 2000 | MDI | EDA |
| Example 7 | PA2 | Copolymerized PTMG | 2000 | MDI | EDA |
| Comparative Example 1 | PA1 | PTMG | 2000 | MDI | EDA |
| Comparative Example 2 | — | — | — | — | — |
| Comparative Example 3 | PA1 | PTMG | 2000 | MDI | EDA |

| Polyurethane | | | | | | PA/PU ratio |
|---|---|---|---|---|---|---|
| No. | Polyol | Number average molecular weight | Isocyanate | Linking agent | Hardness | (weight ratio of solid matters) |
| PU1 | PTMG | 2000 | MDI | 1,4-BD | 80A | 80/20 |
| PU2 | PTMG | 2000 | MDI | 1,4-BD | 75A | 80/20 |
| PU2 | PTMG | 2000 | MDI | 1,4-BD | 75A | 65/35 |
| PU3 | Copolymerized PTMG | 2000 | MDI | 1,4-BD | 77A | 80/20 |
| PU4 | Polybutylene adipate diol | 1000 | MDI | 1,4-BD | 66A | 80/20 |
| PU1 | PTMG | 2000 | MDI | 1,4-BD | 75A | 80/20 |
| PU3 | Copolymerized PTMG | 2000 | MDI | 1,4-BD | 77A | 80/20 |
| — | — | — | — | — | — | 100/0 |
| PU2 | PTMG | 2000 | MDI | 1,4-BD | 75A | 0/100 |
| PU5 | PTMG | 2000 | MDI | 1,4-BD | 90A | 80/20 |

PTMG: Polytetarmethylene glycol

Copolymerized PTMG: Copolymerized diol (NPG/10 mol %) of THF and 2,2-dimethyl-1,3-propanediol (NPG)

MDI: 4,4'-diphenylmethane diisocyanate

EDA: Ethylenediamine 1,4-BD: 1,4-butanediol

TABLE 2

| 44dt/4f | Compression deformation initiation temperature according to TMA (° C.) | The number of seconds up to thermal breakage (seconds) | Recovery rate (%) |
|---|---|---|---|
| Example 1 | 176 | 80 | 88 |
| Example 2 | 167 | 85 | 91 |
| Example 3 | 162 | 70 | 89 |
| Example 4 | 176 | 75 | 92 |
| Example 5 | 174 | 90 | 92 |
| Example 6 | 165 | 75 | 93 |
| Example 7 | 165 | 73 | 94 |
| Comparative Example 1 | 186 | 120 | 91 |
| Comparative Example 2 | 158 | 5 | 84 |
| Comparative Example 3 | 182 | 80 | 82 |

TABLE 3

| | Performance of dyed circular knitted fablic items | | | | | | |
|---|---|---|---|---|---|---|---|
| | Non-elastic fiber | Temperature of preset step (° C.) | Quality of fablic | Processability of fablic Occurrence of yarn breakage in fablic | Occurrence of fray of fablic Washing times until fray occurs (times) | Dimensional stability of fablic Occurrence of curling | Recovery rate of fablic from extension in the latitude direction (%) |
| Example 1 | Nylon processed yarn 74dt/34f | 190 | ○ | None | 30 | ○ | 94 |
| Example 2 | Nylon processed yarn 74dt/34f | 190 | ○ | None | 45 | ○ | 97 |
| Example 3 | Nylon processed yarn 74dt/34f | 190 | ○ | None | 50 | ○ | 95 |
| Example 4 | Nylon processed yarn 74dt/34f | 190 | ○ | None | 35 | ○ | 98 |
| Example 5 | Nylon processed yarn 74dt/34f | 190 | ○ | None | 40 | ○ | 98 |
| Example 6 | Nylon processed yarn 74dt/34f | 190 | ○ | None | 45 | ○ | 98 |
| Example 7 | Nylon processed yarn 74dt/34f | 190 | ○ | None | 50 | ○ | 98 |
| Comparative Example 1 | Nylon processed yarn 74dt/34f | 190 | ○ | None | 10 | X | 97 |
| Comparative Example 3 | Nylon processed yarn 74dt/34f | 190 | ○ | Broken | 40 | ○ | 86 |
| Comparative Example 4 | Nylon processed yarn 74dt/34f | 190 | ○ | None | 20 | X | 86 |

INDUSTRIAL APPLICABILITY

Use of the polyurethane urea elastic fiber of the present invention makes it possible to provide fabrics such as knitted fabric and woven fabric suppressed in occurrence of curls and frays and excellent in sewing processability (knitting design and processing are less limited). In addition, it is possible to provide favorable items very comfortable to wear such as stretchable foundations including girdles, brassieres, intimate goods and underwear, and tights and pantyhose by using fabric requiring no hemming because heat during processing is applied. Other than the above items, the polyurethane elastic fiber of the present invention is suitable for clothing items such as waistbands, body suits, spats, swimming wear, stretchable sports clothes, stretchable outers, medical wear and stretchable lining as well as non-clothing items such as diapers and belts.

The invention claimed is:

1. Polyurethane urea elastic fiber to provide fabrics suppressed in occurrence of curls and frays containing 60 wt % or more of a polyurethane urea polymer and 5 wt % to 40 wt % of a polyurethane compound, obtained by reacting a polyester diol or a polyether diol (excluding polyoxyethylene glycol), having a number average molecular weight of 500 to 2500, an isocyanate compound and a low molecular-weight polyol, wherein the polyurethane compound has no endothermic peak between 80° C. and a temperature at which decomposition of the polyurethane compound starts in differential scanning calorimetry (DSC), and a compression deformation initiation temperature according to thermomechanical analysis (TMA) of the polyurethane urea elastic fiber is not less than 150° C. and not more than 180° C. and the number of seconds up to thermal breakage at 180° C. is 30 seconds or more, wherein hardness of the polyurethane compound is 80 A or less.

2. The polyurethane urea elastic fiber according to claim 1, wherein the polyurethane compound is crosslinked polyurethane.

3. The polyurethane urea elastic fiber according to claim 1, wherein the polyurethane urea is obtained from a copolymerized polyalkylene ether diol serving as a raw material, which is composed of alkylene ethers having a different number of carbon atoms within 2 to 10.

4. The polyurethane urea elastic fiber according to claim 1, wherein the polyurethane compound is obtained from a copolymerized polyalkylene ether dial serving as a raw material, which is composed of alkylene ethers having a different number of carbon atoms within 2 to 10.

5. The polyurethane urea elastic fiber according to claim 1, containing a dimethyl silicone component in an amount of not less than 1.0 wt % and not more than 6.0 wt %.

6. Knitted fabric characterized by using the polyurethane urea elastic fiber according to claim 1 at least in a part.

7. Woven fabric characterized by using the polyurethane urea elastic fiber according to claim 1 at least in a part.

* * * * *

UNITED STATES PATENT AND TRADEMARK OFFICE

CERTIFICATE OF CORRECTION

PATENT NO. : 8,920,922 B2
APPLICATION NO. : 12/307332
DATED : December 30, 2014
INVENTOR(S) : Taro Yamamoto et al.

It is certified that error appears in the above-identified patent and that said Letters Patent is hereby corrected as shown below:

In the Claims

In claim 4, column 20, line 67, "ether dial" should read --ether diol--.

Signed and Sealed this
Fourth Day of August, 2015

Michelle K. Lee

Michelle K. Lee
*Director of the United States Patent and Trademark Office*